US006769359B2

(12) United States Patent
Ishibashi et al.

(10) Patent No.: US 6,769,359 B2
(45) Date of Patent: Aug. 3, 2004

(54) PAPER-WEB HOLDING APPARATUS FOR ROTARY PRINTING PRESS

(75) Inventors: Nobutaka Ishibashi, Yokohama (JP); Kazuo Yamaguchi, Kawasaki (JP); Yoshihiro Iwahashi, Kawasaki (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 19 days.

(21) Appl. No.: 10/263,804

(22) Filed: Oct. 4, 2002

(65) Prior Publication Data

US 2003/0145746 A1 Aug. 7, 2003

(30) Foreign Application Priority Data

Feb. 5, 2002 (JP) ..... 2002-027530

(51) Int. Cl.[7] ..... B41F 13/54

(52) U.S. Cl. ..... 101/216; 101/228; 226/8; 226/33

(58) Field of Search ..... 101/216, 218, 101/212, 228, 480; 226/8, 33, 195, 187; 242/541, 541.4, 541.6, 541.7, 534, 534.1, 555.3, 554.5, 554.6, 563

(56) References Cited

U.S. PATENT DOCUMENTS 4,669,686 A * 6/1987 Huber et al. ..... 242/422.4
5,553,809 A * 9/1996 Oku ..... 242/534.1
5,647,276 A * 7/1997 Tilton, Sr. ..... 101/226
5,775,630 A * 7/1998 Högberg et al. ..... 242/554.6
6,029,927 A * 2/2000 Wohlfahrt et al. ..... 242/527.2
6,098,864 A * 8/2000 Fuchs et al. ..... 226/187
6,129,305 A * 10/2000 Möeller et al. ..... 242/541
6,293,192 B1 * 9/2001 Bartlett ..... 101/212
2001/0006029 A1 * 7/2001 Ogawa et al. ..... 101/228
2002/0179671 A1 * 12/2002 Frodl et al. ..... 226/195
2003/0057315 A1 * 3/2003 Burri et al. ..... 242/532.3

FOREIGN PATENT DOCUMENTS

JP 10-264354 10/1998

* cited by examiner

*Primary Examiner*—Eugene H. Eickholt
(74) *Attorney, Agent, or Firm*—Westerman, Hattori, Daniels & Adrian, LLP

(57) ABSTRACT

A paper-web holding apparatus is provided in a rotary printing press having rollers which form a path for a paper web fed from a paper web feeding unit to travel along to a folding unit via a press unit and around which the paper web is wrapped. The paper-web holding apparatus includes a rotation restraint mechanism provided for at least one selected roller, and a propeller roller mechanism provided for the selected roller. The rotation restraint mechanism restrain rotation of the roller when the rotary printing press is halted, and allows rotation of the roller when the rotary printing press is operated. The propeller roller mechanism has a pressing member which is advanced toward the roller in order to apply pressing force to the roller at least when the rotary printing press is in a halt state.

9 Claims, 8 Drawing Sheets

PAPER-WEB HOLDING APPARATUS FOR ROTARY PRINTING PRESS

BACKGROUND OF THE INVENTION

1. Field of the Invention

The present invention relates to a paper-web holding apparatus for a rotary printing press. The apparatus is adapted to prevent pullback of the paper web which would otherwise be effected by a pullback force which is exerted on the paper web when the rotary printing press is halted. The pullback force is induced by, for example, the weight of the paper web or a return movement of a floating roller, which moves against tension of the paper web traveling with a predetermined force imposed thereon.

2. Description of the Related Art

A rotary printing press prints on a paper web which is fed from a paper web feeding unit having a paper roll. When the rotary printing press is not engaged in printing, a printing cylinder is usually separated from THE paper web, so that the paper web traveling through the press unit receives no resistance from the printing cylinder.

Conventionally, a paper-web holding apparatus has been used for retaining a paper web on a roller that guides the paper web, in order to prevent pullback of the paper web when a rotary printing press is halted for any reason. The pullback of the paper web would otherwise be effected in the direction opposite the traveling direction of the paper web by the weight of the paper web or a return movement of a floating roller. Such a conventional paper-web holding apparatus is disclosed in, for example, Japanese Patent Application Laid-Open (kokai) No. H10-264354.

The paper-web holding apparatus disclosed in the publication is provided in a rotary printing press somewhere between a press unit and a folding unit. When a paper web traveling along a freely rotatable guide roller breaks or gives rise to an abrupt drop in tension thereof with a resultant emergency stop of the rotary printing press, a retaining element—which includes flexible bristles—of the apparatus is temporarily activated so as to press the paper web against the surface of the guide roller, thereby preventing the paper web from slipping off or moving in the direction opposite the original traveling direction thereof.

When a traveling paper web breaks or gives rise to an abrupt drop in tension thereof, the printing cylinder separates from the paper web to stop printing, and the rotary printing press makes an emergency stop. After the emergency stop, the guide roller inertially rotates for a while. If the guide roller has a paper-web holding apparatus, a retaining element of the apparatus is activated to elastically press the paper web against the surface of the inertially rotating guide roller by means of tips of bristles thereof.

A frictional force is generated between the inertially rotating guide roller and the paper web which is pressed against the guide roller. This frictional force functions to feed the paper web downstream, thereby tensing the paper web extending upstream from the guide roller.

That is, in the event of an emergency stop, a drive unit for the retaining element is activated to pivotally move the bristles of the retaining element, whereby the paper web in contact with the guide roller is elastically pressed against the surface of the roller by means of the tips of the bristles.

However, the above-described apparatus disclosed in Japanese Patent Application Laid-Open No. H10-264354 involves the following problem. In the event of an emergency stop of the rotary printing press, each guide roller inertially rotates for a while and then stops. At this time, the weight of a paper web which has been released from the restraint of a printing cylinder or a force associated with a return movement of a floating roller of a paper web feeding unit is exerted on the guide roller via the paper web and causes the guide roller to rotate in reverse. As a result, if the paper web is not broken, the paper web is slacked and thus may be wrinkled when printing resumes. If the paper web is broken, the paper web may slip off the guide roller, resulting in consumption of much labor and time for remedial actions to resume printing.

In the field of newspaper printing, with tendencies toward higher printing speed and functional diversification, a so-called shaftless rotary printing press has recently been becoming dominant. The shaftless rotary printing press employs distributed drive units that operate individually. In the shaftless rotary printing press, shafting among the drive units is absent, and each drive unit has a small power source for driving a corresponding drive system, so that rotary elements of each drive unit rotate very lightly. Therefore, when the shaftless rotary printing press is in a halt status, pulling back of a paper web that extends along a travel path may cause rotations of guide rollers, drag rollers for forcibly feeding the paper web, and folding cylinders.

In the shaftless rotary printing press in a halt status, drag rollers for forcibly feeding a paper web, along with other rotary members, may be caused to rotate by the above-mentioned force, thereby potentially raising a problem. Specifically, after the shaftless rotary printing press completes its regular operation and stops normally, drag rollers which are located above formers at an upper section of a folding unit and against which a paper web is pressed at all times by means of propeller rollers may become unable to withstand a force which is exerted thereon via the paper web by the weight of a vertically extending portion of the paper web or by pullback of the paper web which is effected by a return movement of a floating roller in a paper feeding unit, whereby the drag roller may be rotated in reverse, with a resultant pullback of the paper web in the upstream direction.

As a result, a paper web whose leading end has reached the folding unit and which is retained on a folding cylinder by means of pins which serve as retaining means and are stuck into the leading end is pulled back in the upstream direction, and thus may be torn off the pins. If printing resumes in this state, the paper web does not move following rotation of the folding cylinder, and thus a paper jam arises in the folding unit. Therefore, setup work preliminary to resumption of printing must be performed so as to avoid possible occurrence of this paper jam problem, thereby involving relevant consumption of labor and time.

In multi-page printing involving superposition of a plurality of paper webs, the plurality of paper webs are retained in layers on the folding cylinder by means of pins which serve as retaining means and are stuck into the leading ends of the paper webs. In some cases, pullback forces exerted on the paper webs act on the folding cylinder simultaneously via the paper webs to thereby rotate the folding cylinder in reverse. Such reverse rotation of the folding cylinder causes a phase difference between the printing cylinder and the folding cylinder, thereby yielding, after resumption of printing, a lot of printing which suffers misalignment between a printed image and a cutting line. Also, at a certain angle of reverse rotation of the folding cylinder, the leading ends of the paper webs may come off the pins. Therefore, setup work preliminary to resumption of printing must be performed so as to avoid possible occurrence of the above-mentioned paper jam problem, thereby involving relevant consumption of labor and time.

In order to solve the above-mentioned problems, a paper-web holding apparatus must be employed. However, as is easily understood, the aforementioned conventional paper-web holding apparatus—which employs bristles for elastically pressing a paper web against the surface of a guide roller to thereby retain the paper web on the roller—fails to solve the problem.

SUMMARY OF THE INVENTION

An object of the present invention is to solve the above-mentioned problems in the conventional paper-web holding apparatus in a rotary printing press, and to provide a paper-web holding apparatus for a rotary printing press which can reliably hold a paper web on a selected roller, in the event of an emergency stop of the rotary printing press caused by fracture of a paper web or abrupt drop in tension of a paper web during the course of printing or in the event of a normal stop of the rotary printing press after completion of regular printing, to thereby prevent slack of the paper web, slippage of the paper web from the roller, detachment of the paper web from pins of a folding cylinder, and the like, thereby reducing labor and work time involved in startup of the rotary printing press.

To achieve the above object, the prevent invention provides a paper-web holding apparatus for a rotary printing press having rollers which form a path for a paper web fed from a paper web feeding unit to travel along to a folding unit via a press unit and around which the paper web is wrapped. The apparatus comprises a rotation restraint mechanism provided for at least one selected roller and adapted to restrain rotation of the roller when the rotary printing press is halted, and to allow rotation of the roller when the rotary printing press is operated; and a paper presser mechanism provided for the selected roller and having a pressing member which is retreatably advanced toward the roller in order to apply pressing force to the roller at least when the rotary printing press is in a halt state.

The rotation restraint mechanism comprises a hydraulically or magnetoelectrically operable brake unit provided in the vicinity of an end portion of the roller, and a control unit for controlling operation of the brake unit.

The paper-web holding apparatus may be provided for any of guide rollers and drag rollers, including a drag roller located above and upstream of a former for feeding a paper web to the folding unit, or may be provided for each of rollers selected appropriately therefrom.

When the rotary printing press is halted, rotation of at least one roller appropriately selected from drag rollers and guide rollers which form a web path extending to a folding unit via a press unit is restrained. Further, by means of the paper presser mechanism provided for the selected roller, a paper web is pressed against the selected roller whose rotation is restrained. Therefore, the roller is not rotated by gravity or tension imposed on the paper web, and the paper web does not slip on the surface of the roller; i.e., the paper web remains unmoved.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will next be described in detail with reference to the drawings.

Figure 9:
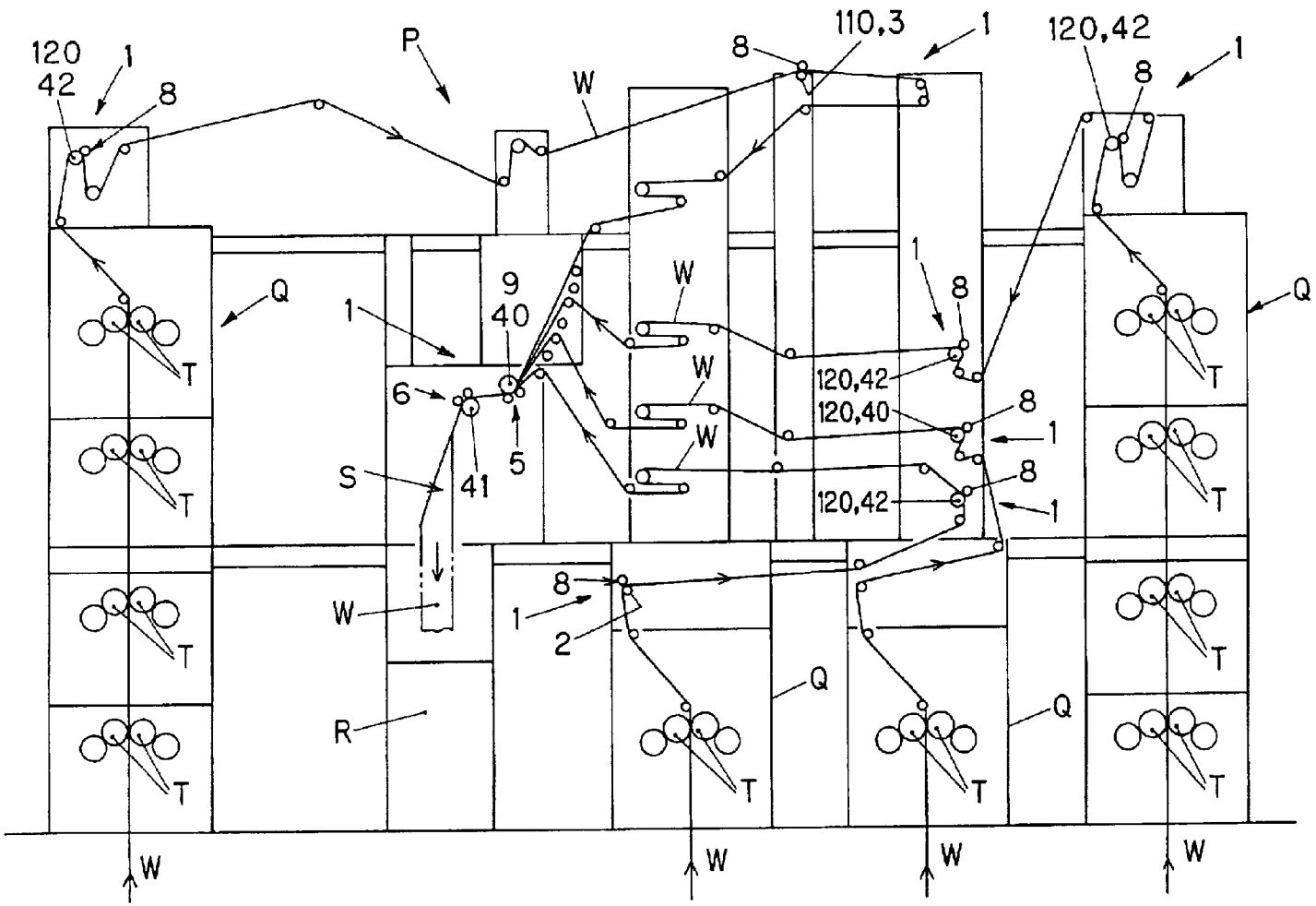
FIG. 9 is a schematic explanatory view showing the entire configuration of a shaftless offset rotary printing press for printing newspaper to which the paper-web holding apparatuses according to the embodiments of the present invention are applicable.
Figure 10:
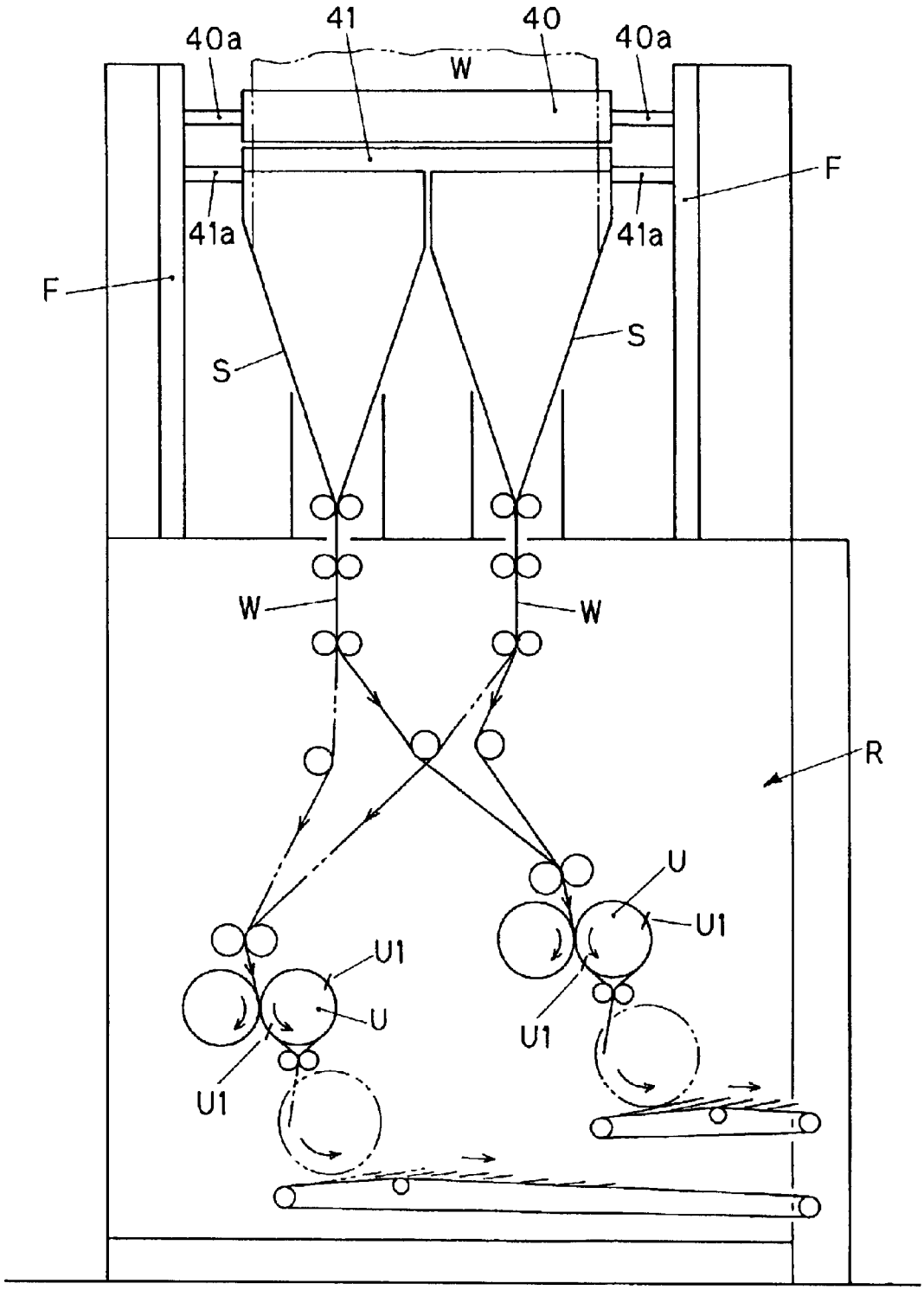
FIG. 10 is a schematic explanatory view showing a folding unit of the shaftless offset rotary printing press of FIG. 9 as viewed from the front side of a former.

FIGS. 9 and 10 show a shaftless offset rotary printing press for printing newspaper (hereinafter referred to as a rotary printing press) to which paper-web holding apparatuses according to the embodiments of the present invention are applicable.

As shown in FIGS. 9 and 10, a rotary printing press P includes a plurality of press units Q, each of which has groups of printing cylinders T arranged at multiple levels; unillustrated paper web feeding units provided for the corresponding press units Q; and a folding unit R having a plurality of folding cylinders U. A travel path for a paper web W extends from each of the paper web feeding units, which each have a floating roller, to the folding unit R via the printing cylinders T in the corresponding press units Q. The travel path is formed of guide rollers (a first guide roller 2, a second guide roller 3, etc.) for guiding the paper web W, drag rollers (a first drag roller 40, a second drag roller 41, a third drag roller 42, etc.) for guiding and dragging the paper web W, and paper web guide members such as turn bars.

When the rotary printing press P is operated, the paper webs W are fed to the press units Q from the corresponding paper web feeding units each having a floating roller. As shown in FIG. 9, the thus-fed paper webs W undergo printing in the corresponding press units Q while traveling along guide rollers and drag rollers arranged along the travel paths.

Usually, the traveling wide paper webs W are each slit lengthwise into two web strips by use of an unillustrated slitter located upstream of the folding unit R. The two web strips are superposed on each other and then led to a single former S. Alternatively, as shown in FIG. 10, the traveling wide paper webs W are each slit lengthwise into two web strips by use of the unillustrated slitter such that the width thereof corresponds to the width of two formers S arranged side by side. The two web strips are led to the corresponding right- and left-hand formers S and then to the folding unit R. The paper webs W led to the folding unit R reach the corresponding folding cylinders U and are then stuck by pins U1 of the folding cylinders U. The paper webs W on the corresponding folding cylinders U undergo a folding process and are then delivered as copies of printing.

Figure 1:
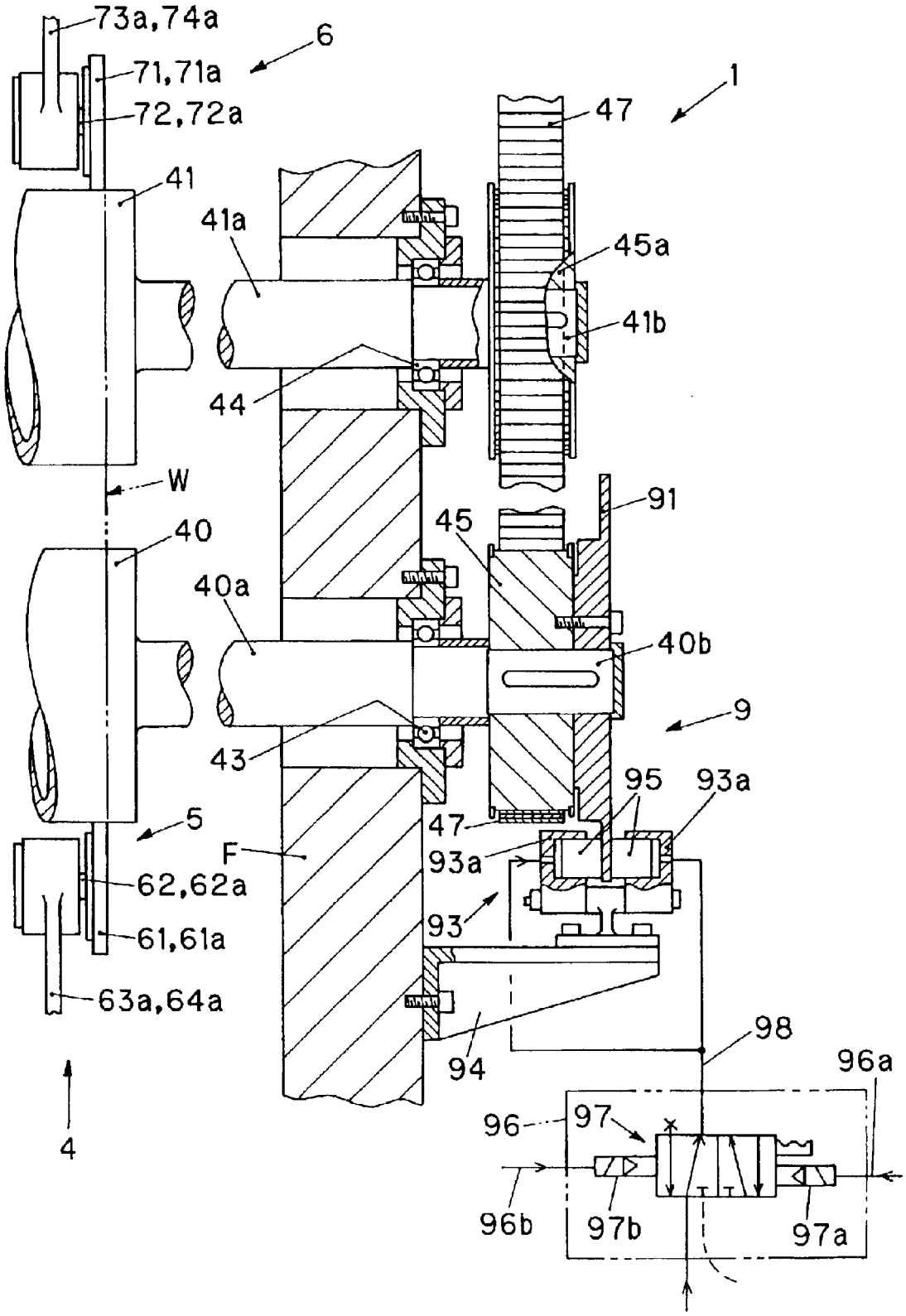
FIG. 1 is a partially sectioned front view of a paper-web holding apparatus according to a first embodiment of the present invention.
Figure 2:
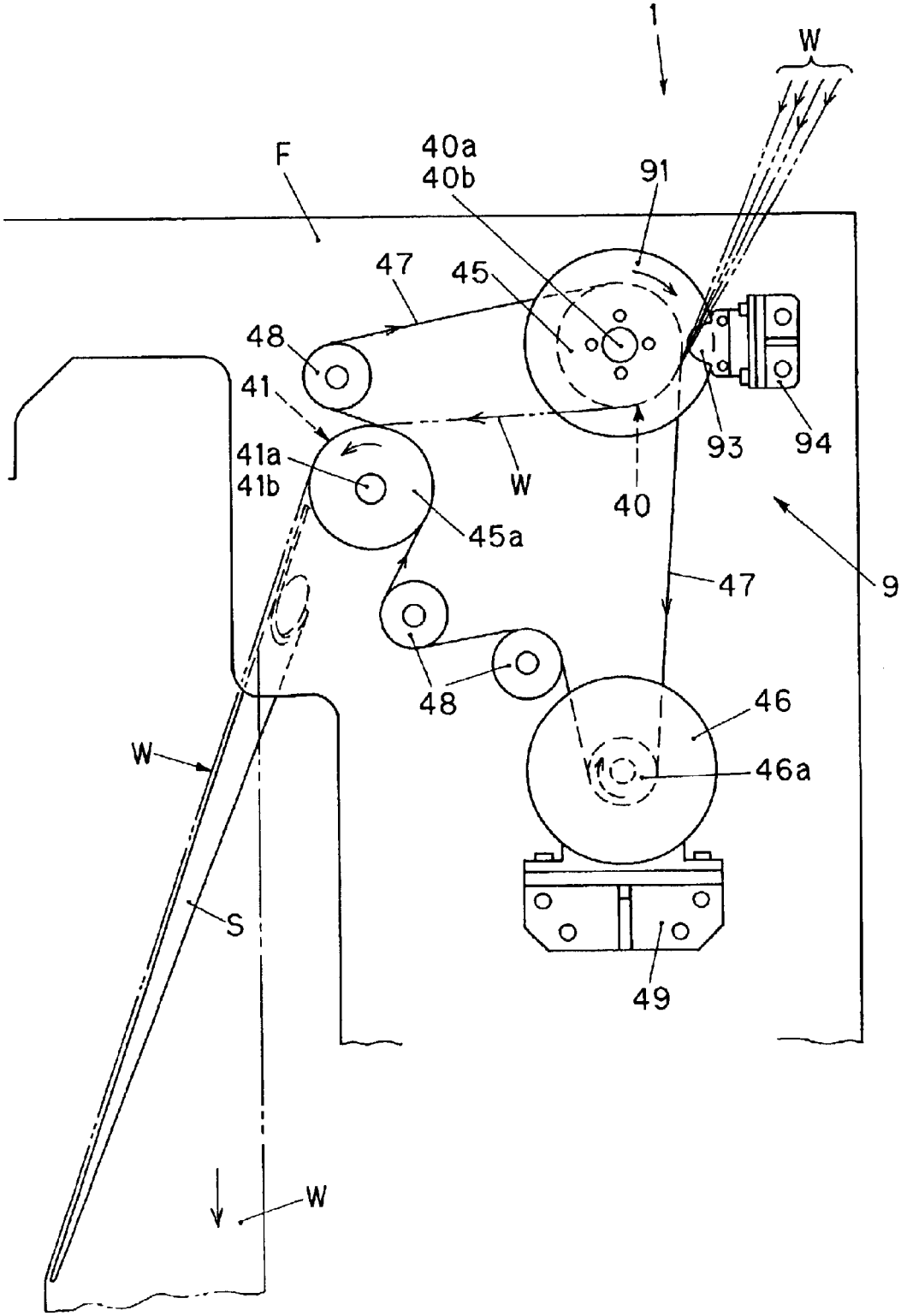
FIG. 2 is a schematic view showing the configuration of a first drag roller apparatus to which the paper-web holding apparatus according to the first embodiment is applicable.
Figure 3:
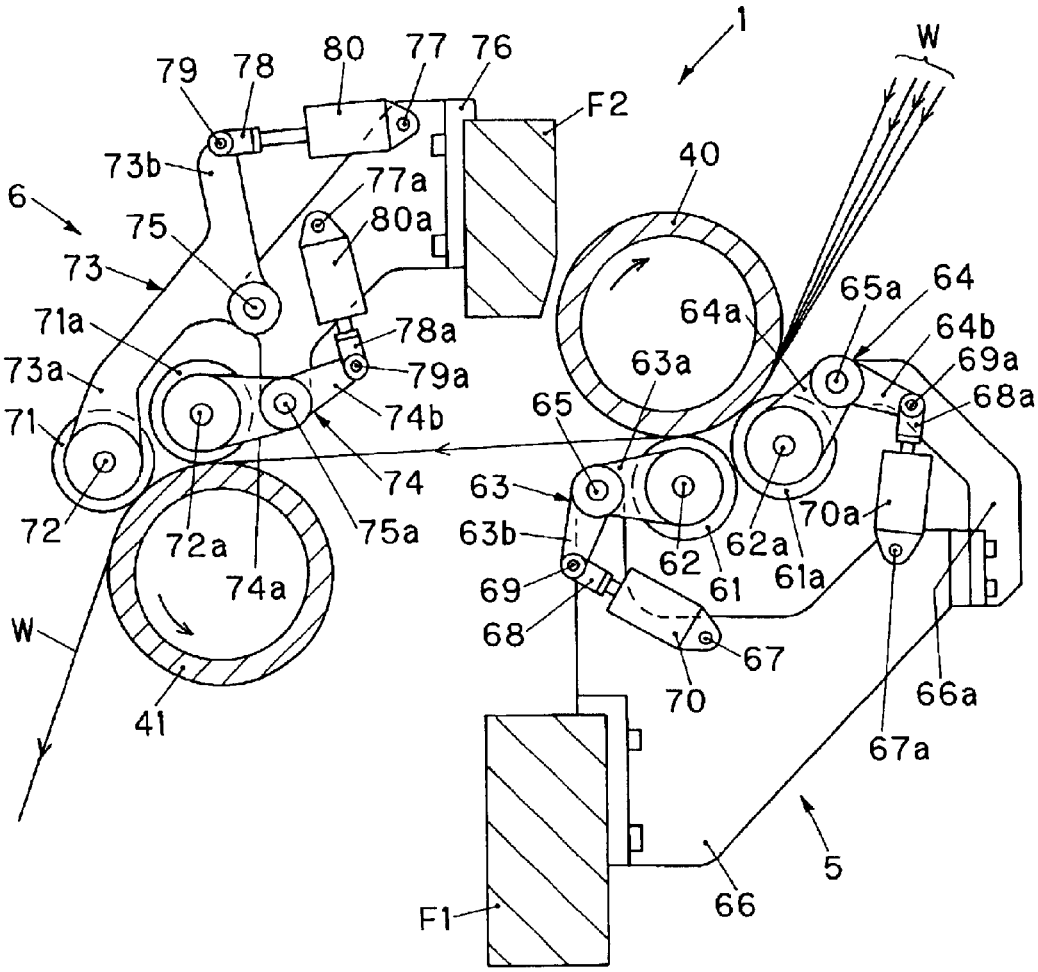
FIG. 3 is a partially sectioned side view of the paper-web holding apparatus according to the first embodiment.
Figure 4:
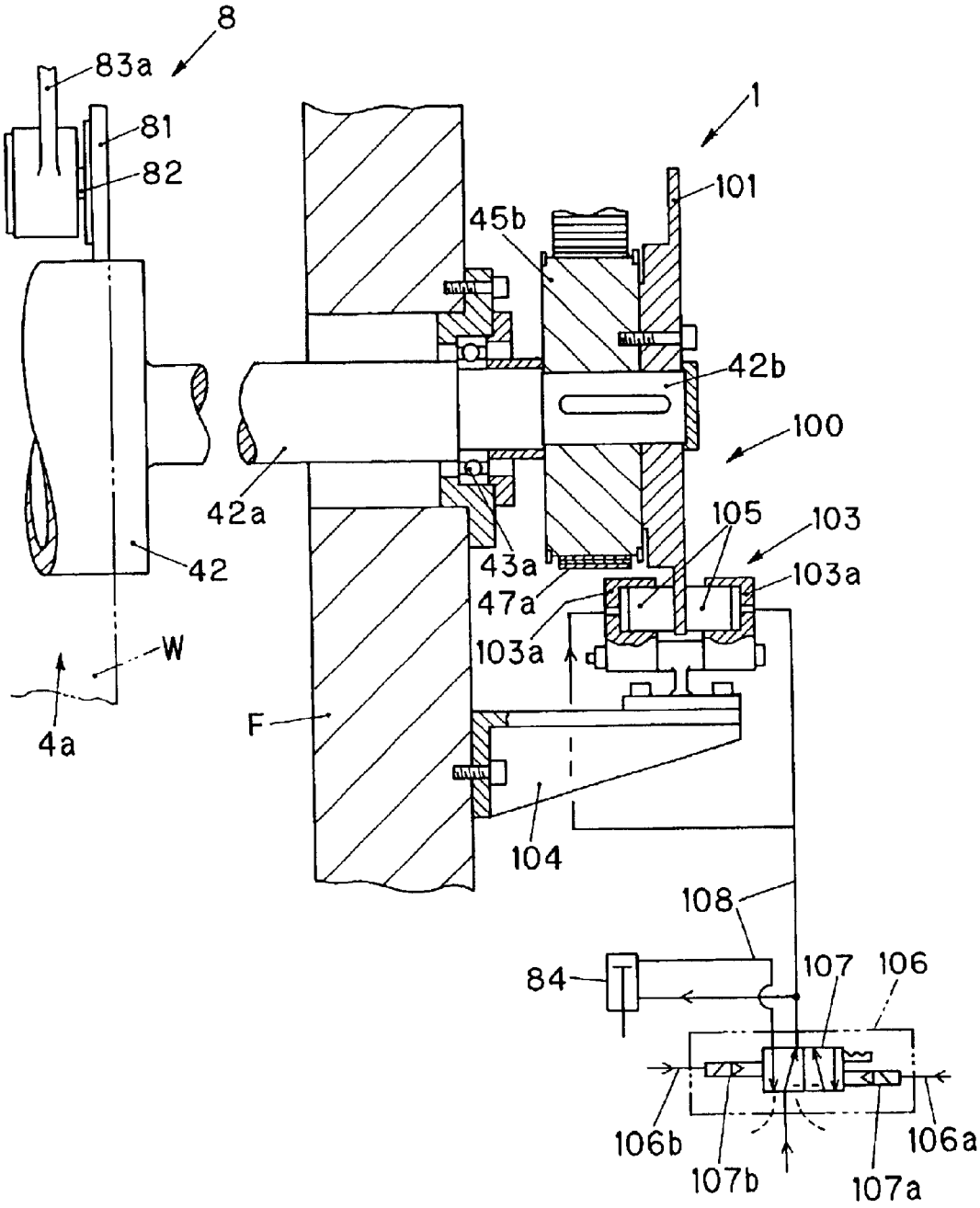
FIG. 4 is a partially sectioned front view of a paper-web holding apparatus according to a second embodiment of the present invention.
Figure 5:
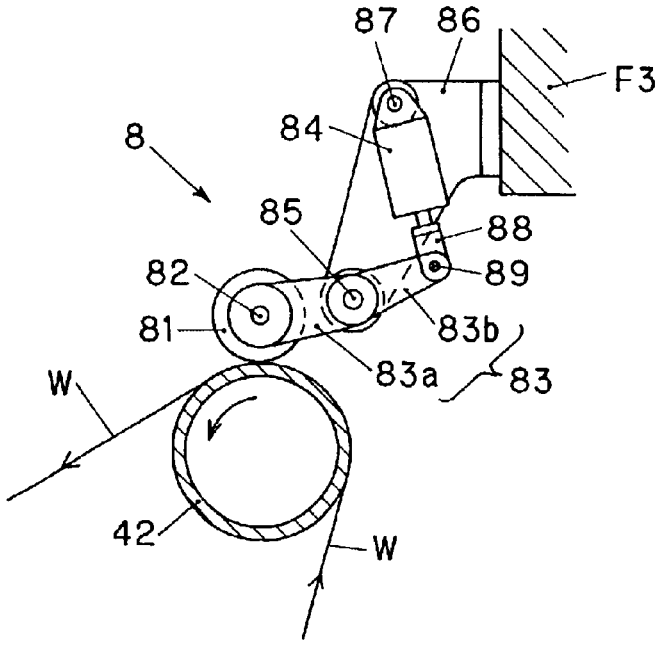
FIG. 5 is a partially sectioned side view of the paper-web holding apparatus according to the second embodiment.

The rotary printing press P employs different types of drag roller apparatus; e.g., a drag roller apparatus (a first drag roller apparatus 4) shown in FIGS. 1 to 3, which includes two drag rollers (a first drag roller 40 and a second drag roller 41), and a drag roller apparatus (a second drag roller apparatus 4*a*) shown in FIGS. 4 and 5, which includes a single drag roller (a third drag roller 42).

The first drag roller apparatus 4 is used for reliably dragging the paper web W. Particularly, the first drag roller apparatus 4 is provided immediately upstream of the former S of the folding unit R. In order to reliably drag a plurality of superposed paper webs W, the first drag roller apparatus 4 has two paper presser mechanisms (a first paper presser mechanism 5 and a second paper presser mechanism 6), which face the corresponding first and second drag rollers 40 and 41.

The upstream first drag roller 40 and the downstream second drag roller 41 are in contact with a plurality of superposed paper webs W, which have undergone printing in the corresponding press units Q, such that the first drag roller 40 contacts one side of the superposed paper webs W while the second drag roller 41 contacts the opposite side of the superposed paper webs W. When the rotary printing press P is operating, the first and second drag rollers 40 and 41 are rotated at a peripheral speed appropriately higher than that of a printing cylinder.

FIGS. 1 and 10 show the structure of the first drag roller apparatus 4 (FIG. 1 shows one end portion thereof). A shaft 40*a* integral with the first drag roller 40 and a shaft 41*a* integral with the second drag roller 41 are rotatably supported at opposite ends by frames F, which stand in opposition to each other, via bearings 43 and 44, respectively. One shaft end portion 40*b*/41*b* of the shaft 40*a*/41*a* projects from the frame F. Toothed pulleys 45 and 45*a* are attached to the shaft end portions 40*b* and 41*b*, respectively.

As shown in FIG. 2, a motor 46 is independently mounted on a bracket 49 which is fixedly attached to the outside of the frame F. A toothed belt 47 is wound around: a toothed pulley 46*a*, which is attached to an output shaft of the motor 46; the toothed pulleys 45 and 45*a* of the first and second drag rollers 40 and 41; and guide pulleys 48, which are rotatably attached to the frame F at appropriate positions and partially form a travel path of the toothed belt 47. Thus is formed a belt transmission mechanism.

When the rotary printing press P is operating, the motor 46 drives the belt transmission mechanism, whereby the first drag roller 40 and the second drag roller 41 are rotated in mutually opposite directions (in FIG. 3, the first drag roller 40 is rotated clockwise, whereas the second drag roller 41 is rotated counterclockwise).

As shown in FIG. 3, the first paper presser mechanism 5 includes two rotatable propeller rollers 61 and 61*a*, and the second paper presser mechanism 6 includes two rotatable propeller rollers 71 and 71*a*. The propeller rollers 61 and 61*a* are located along the surface of the first drag roller 40 while facing the paper web W wrapped around the first drag roller 40, and can advance toward and retreat from the first drag roller 40. Similarly, the propeller rollers 71 and 71*a* are located along the surface of the second drag roller 41 while facing the paper web W wrapped around the second drag roller 41), and can advance toward and retreat from the second drag roller 41.

A single first paper presser mechanism 5 and a single second paper presser mechanism 6 are provided at an appropriate position along the width direction of the traveling paper web W. Alternatively, a plurality of first paper presser mechanisms 5 and a plurality of second paper presser mechanisms 6 are provided at appropriate intervals along the width direction.

In the illustrated example, at least two first paper presser mechanisms 5 and two second paper presser mechanisms 6 are provided at positions corresponding to the opposite edge portions of the paper web W.

A plurality of superposed paper webs W coming from the corresponding press units Q are wrapped around the circumferential surface of the first drag roller 40 over a predetermined angle. Opposite edge portions of the superposed paper webs W are pressed against the surface of the first drag roller 40 by means of the propeller rollers 61 and 61*a*. As the first drag roller 40 is rotated, the superposed paper webs W are dragged in unison and fed to the next second drag roller 41.

The superposed paper webs W coming from the first drag roller 40 are wrapped around the circumferential surface of the second drag roller 41 over a predetermined angle. Opposite edge portions of the superposed paper webs W are pressed against the surface of the second drag roller 41 by means of the propeller rollers 71 and 71*a*. As the second drag roller 41 is rotated, the superposed paper webs W are dragged in unison and fed to the former S of the folding unit R. The superposed paper webs W are folded longitudinally while passing through the former S, and then fed to the folding unit R.

Two pairs of propeller rollers 61 and 61*a* are provided in opposition to the corresponding opposite edge portions of the superposed paper webs W wrapped around the first drag roller 40. Since the two pairs are identical with each other, the following description will cover only one pair of propeller rollers 61 and 61*a* that faces one edge portion of the superposed paper webs W. Similarly, two pairs of propeller rollers 71 and 71*a* are provided in opposition to the corresponding opposite edge portions of the superposed paper webs W wrapped around the second drag roller 41. Since the two pairs are identical with each other, the following description will cover only one pair of propeller rollers 71 and 71*a* that faces one edge portion of the superposed paper webs W.

As shown in FIG. 3, brackets each having an appropriate shape are attached to corresponding stays F1 and F2, which extend in parallel between the opposite frames F.

A forked bracket 66 is provided for the first drag roller 40. A base portion of the bracket 66 is attached to the stay F1. Further, a base portion of a bracket 66*a* is attached to one fork end portion of the bracket 66. A bracket 76 is provided for the second drag roller 41. The bracket 76 is designed to have an appropriate shape different from the shape of the bracket 66. A base portion of the bracket 76 is attached to the stay F2.

An intermediate portion of a pivotal arm 63 is pivotably attached to the other fork end portion of the bracket 66 by means of a pivot shaft 65. An intermediate portion of a pivotal arm 64 is pivotably attached to an end portion of the bracket 66*a* by means of a pivot shaft 65*a*. An intermediate portion of a pivotal arm 73 is pivotably attached to an intermediate portion of the bracket 76 by means of a pivot shaft 75. An intermediate portion of a pivotal arm 74 is pivotably attached to an end portion of the bracket 76 by means of a pivot shaft 75*a*. These pivotal arms 63, 64, 73, and 74 each assume an appropriate shape such as a straight shape or a bent shape.

Mutually facing portions of the pivotal arms 63 and 64 serve as roller arms 63*a* and 64*a*, and opposite portions serve as cylinder arms 63*b* and 64*b*. Mutually facing portions of the pivotal arms 73 and 74 serve as roller arms 73*a* and 74*a*, and opposite portions serve as cylinder arms 73*b* and 74*b*.

Propeller rollers 61 and 61*a* are rotatably attached to corresponding end portions of the roller arms 63*a* and 64*a* by means of pins 62 and 62*a*, respectively. Similarly, propeller rollers 71 and 71*a* are rotatably attached to corresponding end portions of the roller arms 73*a* and 74*a* by means of pins 72 and 72*a*, respectively.

A pair of hydraulic cylinders 70 and 70*a* are pivotably connected to the bracket 66 at appropriate positions. Specifically, an end portion of a cylinder body of the hydraulic cylinder 70 or 70*a* is pivotably connected to the bracket 66 by means of a pin 67 or 67*a*. An end portion 68 or 68*a* of a piston rod of the hydraulic cylinder 70 or 70*a* is pivotably connected to an end portion of the cylinder arm 63*b* or 64*b* of the pivotal arm 63 or 64 by means of a pin 69 or 69*a*. Similarly, a pair of hydraulic cylinders 80 and 80*a* are pivotably connected to the bracket 76 at appropriate positions. Specifically, an end portion of a cylinder body of the hydraulic cylinder 80 or 80*a* is pivotably connected to the bracket 76 by means of a pin 77 or 77*a*. An end portion 78 or 78*a* of a piston rod of the hydraulic cylinder 80 or 80*a* is pivotably connected to an end portion of the cylinder arm 73*b* or 74*b* of the pivotal arm 73 or 74 by means of a pin 79 or 79*a*.

The axes of the above-mentioned pin connections of the propeller rollers 61, 61*a*, 71, and 71*a*, the pivotal arms 63, 64, 73, and 74, and the hydraulic cylinders 70, 70*a*, 80, and 80*a* are parallel with the axes of rotation of the drag rollers 40 and 41. Unillustrated hydraulic lines are connected to the corresponding cylinder bodies of the hydraulic cylinders 70, 70*a*, 80, and 80*a*, whereby pressure fluid having an appropriately regulated pressure can be supplied to and drained from the cylinder bodies.

Supply of pressure fluid having an appropriately regulated pressure to or drainage of the fluid from the hydraulic cylinders 70, 70*a*, 80, and 80*a* causes expansion or retraction of the piston rods of the cylinders, whereby the pivotal arms 63 and 64 are pivoted about the pivot shafts 65 and 65*a*, respectively, in mutually opposite directions, and the pivotal arms 73 and 74 are pivoted about the pivot shafts 75 and 75*a*, respectively, in mutually opposite directions.

Specifically, referring to FIG. 3, when the piston rods expand, the pivotal arms 63 and 74 are pivoted clockwise, and the pivotal arms 64 and 73 are pivoted counterclockwise, whereby the propeller rollers 61 and 61*a* retreat from the superposed paper webs W wrapped around the first drag roller 40; the propeller roller 71*a* retreats from the superposed paper webs W wrapped around the second drag roller 41; and the propeller roller 71 presses the superposed paper webs W against the surface of the second drag roller 41.

When the piston rods retract, the pivotal arms 63 and 74 are pivoted counterclockwise, and the pivotal arms 64 and 73 are pivoted clockwise, whereby the propeller rollers 61 and 61*a* press the superposed paper webs W against the surface of the first drag roller 40; the propeller roller 71*a* presses the superposed paper webs W against the surface of the second drag roller 41; and the propeller roller 71 retreats from the superposed paper webs W wrapped around the second drag roller 41.

When the rotary printing press P is operating, the hydraulic cylinders 70, 70*a*, 80, and 80*a* are activated such that the propeller rollers 61 and 61*a* press the superposed paper webs W against the surface of the first drag roller 40, and the propeller rollers 71 and 71*a* press the superposed paper webs W against the surface of the second drag roller 41.

Next, as shown in FIGS. 4, 5, and 9, the second drag roller apparatus 4*a* is disposed along the corresponding travel path of the paper web W at an appropriate position located downstream of the corresponding press unit Q. The third drag roller 42 is in contact with either the front or back side of the paper web W which has undergone printing in the corresponding press unit Q. When the rotary printing press P is operating, the third drag roller 42 is rotated at a peripheral speed appropriately higher than that of the printing cylinder.

FIG. 4 shows the structure of the second drag roller apparatus 4*a* (FIG. 4 shows one end portion thereof). A shaft 42*a* integral with the third drag roller 42 is rotatably supported at opposite ends by the frames F, which stand in opposition to each other, via bearings 43*a*. One shaft end portion 42*b* of the shaft 42*a* projects from the frame F. A toothed pulley 45*b* is attached to the shaft end portion 42*b*.

A toothed belt 47*a* is wound around a toothed pulley attached to an output shaft of an unillustrated, independently provided motor and around the toothed pulley 45*b* of the third drag roller 42, thereby forming a belt transmission mechanism.

When the rotary printing press P is operating, the motor drives the belt transmission mechanism, whereby the third drag roller 42 is rotated (counterclockwise in FIG. 5). The paper webs W fed from the corresponding press units Q are wrapped, over a predetermined angle, around the circumferential surfaces of the corresponding third drag rollers 42 disposed in the corresponding travel paths. As the drag rollers 42 are rotated, the corresponding paper webs W are dragged in unison and then superposed on one another. Thus-superposed paper webs W are fed toward the first drag roller apparatus 4.

Figure 6:
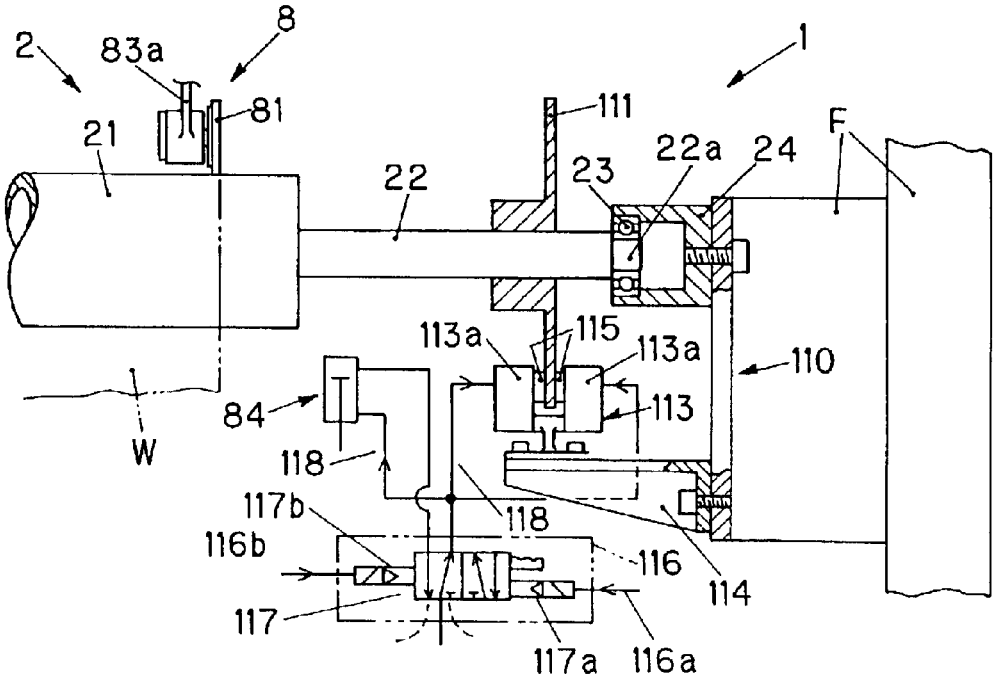
FIG. 6 is a partially sectioned front view of a paper-web holding apparatus according to a third embodiment of the present invention.

Next, the first guide roller 2 (FIG. 6 shows one end portion thereof) includes a roller body 21 and shafts 22 projecting from the corresponding opposite ends of the roller body 21. Shaft end portions 22*a* of the shafts 22 are supported, via corresponding bearings 23, by corresponding housings 24 attached to the respective frames F. The first guide roller 2 guides the traveling paper web W to thereby rotate.

Figure 7:
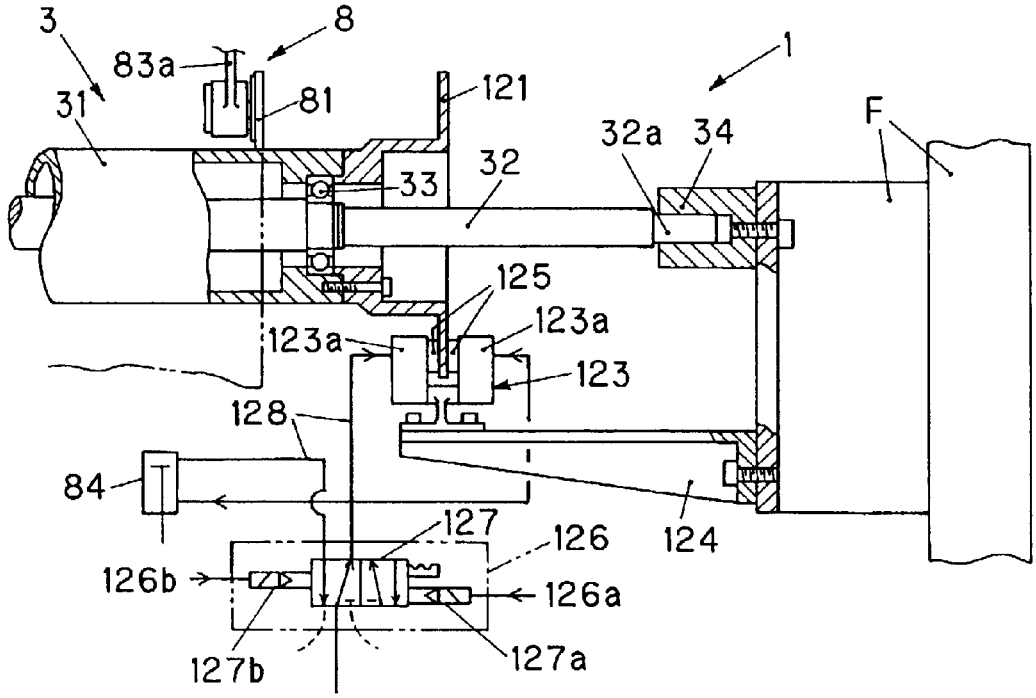
FIG. 7 is a partially sectioned front view of a paper-web holding apparatus according to a fourth embodiment of the present invention.

The second guide roller 3 (FIG. 7 shows one end portion thereof) includes a roller body 31 and a shaft 32, which extends through the roller body 31 and projects from the opposite ends of the roller body 31. Opposite shaft end portions 32*a* of the shaft 32 are attached to the respective frames F by means of respective support elements 34. The roller body 31 is supported at opposite end portions thereof by the shaft 32 via corresponding bearings 33. As in the case of the first guide roller 2, the second guide roller 3 guides the traveling paper web W to thereby rotate.

In the rotary printing press P, paper-web holding apparatuses 1 are provided as appropriate for the first drag roller apparatus 4, the second drag roller apparatuses 4*a*, the first guide rollers 2, and the second guide rollers 3.

The paper-web holding apparatus 1 is embodied in the following four forms, which are combined as appropriate in practical use.

The paper-web holding apparatus 1 according to a first embodiment of the present invention is provided for the above-described first drag roller apparatus 4 or a like drag roller apparatus. The paper-web holding apparatus 1 includes a first rotation restraint mechanism 9, a first paper presser mechanism 5, and a second paper presser mechanism 6 (see FIGS. 1, 2, and 3). The first rotation restraint mechanism 9 is adapted to restrain rotation of the first and second drag rollers 40 and 41 when the rotary printing press P is halted, and to allow the rotation when the rotary printing press P is operated. The first and second paper presser mechanisms 5 and 6 are adapted to press the paper web W against the surface of the first and second drag rollers 40 and 41, respectively.

The paper-web holding apparatus 1 according to a second embodiment of the present invention is provided for the above-described second drag roller apparatus 4*a* or a like drag roller apparatus. The paper-web holding apparatus 1 includes a second rotation restraint mechanism 100 and a third paper presser mechanism 8 (see FIGS. 4 and 5). The second rotation restraint mechanism 100 is adapted to restrain rotation of the third drag roller 42 when the rotary printing press P is halted, and to allow the rotation when the rotary printing press P is operated. The third paper presser mechanism 8 is adapted to press the paper web W against the surface of the third drag roller 42 at least when the rotary printing press P is halted.

The paper-web holding apparatus 1 according to a third embodiment of the present invention is provided for the first guide roller 2. The paper-web holding apparatus 1 includes a third rotation restraint mechanism 110 and the third paper presser mechanism 8 (see FIGS. 6 and 8). The third rotation restraint mechanism 110 is adapted to restrain rotation of the first guide roller 2 when the rotary printing press P is halted, and to allow the rotation when the rotary printing press P is operated. The third paper presser mechanism 8 is adapted to press the paper web W against the surface of the first guide roller 2 when the rotary printing press P is halted.

The paper-web holding apparatus 1 according to a fourth embodiment of the present invention is provided for the second guide roller 3. The paper-web holding apparatus 1 includes a fourth rotation restraint mechanism 120 and the third paper presser mechanism 8 (see FIGS. 7 and 8). The fourth rotation restraint mechanism 120 is adapted to restrain rotation of the second guide roller 3 when the rotary printing press P is halted, and to allow the rotation when the rotary printing press P is operated. The third paper presser mechanism 8 is adapted to press the paper web W against the surface of the second guide roller 3 when the rotary printing press P is halted.

Figure 8:
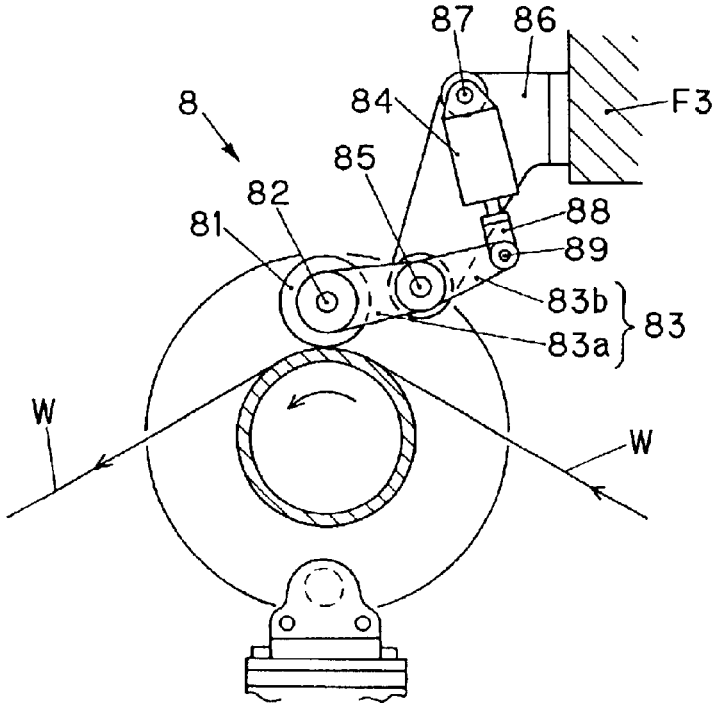
FIG. 8 is a partially sectioned side view of the paper-web holding apparatus according to the third or fourth embodiment.

The paper-web holding apparatuses 1 according to the second, third, and fourth embodiments include substantially the same paper presser mechanism; i.e., the third paper presser mechanism 8 as shown in FIGS. 5 and 8.

The paper-web holding apparatus 1 according to the first embodiment will next be described.

The paper-web holding apparatus 1 according to the first embodiment employs, as a paper presser mechanism, the first paper presser mechanism 5 and the second paper presser mechanism 6. In order to reliably drag a plurality of superposed paper webs W and feed to the folding unit R, even when the rotary printing press P is operated, the first and second paper presser mechanisms 5 and 6 remain pressing the superposed paper webs W against the surface of the first and second drag rollers 40 and 41, respectively.

As shown in FIGS. 1 and 2, the first rotation restraint mechanism 9 includes a first brake disk 91, a first brake unit 93, and a first control unit 96. The first brake disk 91 is attached to one shaft end of the shaft of one drag roller; specifically, in FIG. 1, the shaft end portion 40*b* of the shaft 40*a* of the first drag roller 40, to which the toothed pulley 45 is attached. The first brake unit 93 is adapted to hydraulically restrain rotation of the first brake disk 91. The first control unit 96 controls operation of the first brake unit 93 by changing over operation modes of a solenoid valve 97 for changing flow paths of pressure fluid.

The first brake disk 91 is attached to the outer side of the toothed pulley 45, which in turn is attached to the shaft end portion 40*b* of the first drag roller 40, so that the first brake disk 91 can rotate together with the first drag roller 40.

The first brake unit 93 includes two cylinder members 93*a* and two brake members 95. The cylinder members 93*a* are mounted on a bracket 94, which is attached to the frame F, in such a manner as to face each other with the first brake disk 91 located therebetween and such that open ends thereof are located in the vicinity of corresponding braking faces of the first brake disk 91. The brake members 95 are slidably received within the corresponding cylinder members 93*a* in such a manner as to be able to grip the first brake disk 91 through contact, from opposite sides, with the braking faces of the first brake disk 91 and to retreat from the braking faces.

The first control unit 96 includes a pipe line 98 and the solenoid valve 97. The pipe line 98 connects the cylinder members 93*a* of the first brake unit 93 to an unillustrated pressure fluid source and to an unillustrated drain port. The solenoid valve 97 is disposed in the pipe line 98 and is operated by means of an operation signal 96*a* and a stop signal 96*b* to be input from an unillustrated control unit of the rotary printing press P. Upon input of the operation signal 96*a* to one solenoid 97*a*, the solenoid valve 97 changes over fluid flow paths so as to establish communication between the drain port and the cylinder members 93*a*. Upon input of the stop signal 96*b* to the other solenoid 97*b*, the solenoid valve 97 changes over fluid flow paths so as to establish communication between the pressure fluid source and the cylinder members 93*a* (see FIG. 1).

When the cylinder members 93*a* communicate with the pressure fluid source, pressure fluid fed to the cylinder members 93*a* causes the brake members 95 to be pressed against the corresponding braking faces of the first brake disk 91, thereby braking the first brake disk 91. When the cylinder members 93*a* communicate with the drain port, an unillustrated compression spring causes the brake members 95 to retreat from the braking faces of the first brake disk 91, and the pressure fluid is drained from the cylinder members 93*a* to the drain port. Thus, the first brake disk 91 is released from grip by the brake members 95; i.e., the first brake disk 91 is released from restraint.

Next will be described operation of the paper-web holding apparatus 1 according to the first embodiment described above.

When the rotary printing press P, which has been halted, enters an operation status, the paper-web holding apparatus 1 operates in the following manner. The operation signal 96*a* is input to the first control unit 96 of the first rotation restraint mechanism 9 shown in FIG. 1 from an unillustrated control unit of the rotary printing press P, to thereby activate the solenoid 97*a*. The solenoid valve 97 immediately changes over flow paths of pressure fluid such that the pipe line 98 connected to the cylinder members 93*a* of the first brake unit 93 communicates with an unillustrated drain port.

Hereupon, imposition of fluid pressure on the brake members 95 is canceled. As a result, an unillustrated compression spring causes the brake members 95, which have been gripping the first brake disk 91, to retreat from the braking faces of the first brake disk 91, and the pressure fluid is drained from the cylinder members 93*a* to the drain port. Thus, the first brake disk 91 is released from restraint.

As shown in FIGS. 2, 3, and 10, as the rotary printing press P is operated, the motor 46 rotates synchronously with rotation of the printing cylinders T. Rotation of the toothed pulley 46*a* attached to the output shaft of the motor 46 is transmitted via the toothed belt 47 to the toothed pulley 45 of the first drag roller 40 and to the toothed pulley 45*a* of the second drag roller 41. The first drag roller 40 is rotated clockwise in FIG. 3, whereas the second drag roller 41 is rotated counterclockwise in FIG. 3.

When the rotary printing press P is operated, the hydraulic cylinders 70, 70*a*, 80, and 80*a* are hydraulically operated such that pressure fluid is fed into a cylinder body of each of the hydraulic cylinders from one side of the cylinder body via an unillustrated hydraulic circuit, while pressure fluid is drained from the other side of the cylinder body via the hydraulic circuit. Specifically, the hydraulic cylinders 70, 70*a*, and 80*a* are operated such that the piston rods thereof are retracted, whereas the hydraulic cylinder 80 is operated such that the piston rod thereof is expanded. Therefore, the pivotal arms 63, 73, and 74 are pivoted counterclockwise about the respective pivot shafts 65, 74, and 75, whereas the pivotal arm 64 is pivoted clockwise about the pivot shaft 65*a*.

As a result, the propeller rollers 61 and 61*a* press the superposed paper webs W against the surface of the first drag roller 40, while the propeller rollers 71 and 71*a* press the superposed paper webs W against the surface of the second drag roller 41.

Thus, the superposed paper webs W are fed downward to, for example, the folding unit R while being held between the surface of the rotating first drag roller 40 and the propeller rollers 61 and 61*a* and between the surface of the rotating second drag roller 41 and the propeller rollers 71 and 71*a*.

Next, when the rotary printing press P is normally halted after completion of regular operation, an unillustrated motor stops. When paper breaks during the course of printing, the motor starts decelerating to make an emergency stop. Hereupon, the motor 46 stops. Also, the stop signal 96*b* is input to the first control unit 96 of the first rotation restraint mechanism 9 from the control unit of the rotary printing press P to thereby activate the solenoid 97*b*. The solenoid valve 97 immediately changes over flow paths of pressure fluid so as to establish communication between the unillustrated pressure fluid source and the pipe line 98 connected to the two cylinder members 93*a* of the first brake unit 93.

The pressure fluid is fed into the cylinder members 93*a* to thereby impose a hydraulic pressure on the two brake members 95. The brake members 95, which have been retreated from the corresponding braking faces of the first brake disk 91, are pressed against the braking faces against a force of an unillustrated compression spring, thereby braking the first brake disk 91 to thereby restrain rotation of the first brake disk 91.

Therefore, the first drag roller 40 and the second drag roller 41, which are linked for unitary rotation via the toothed belt 47, are stopped in unison.

In the first embodiment, the mutually facing propeller rollers 61 and 61*a* of the first paper presser mechanism 5 and the mutually acing propeller rollers 71 and 71*a* of the second paper presser mechanism 6 function to feed the superposed paper webs W downward in cooperation with the first and second drag rollers 40 and 41. Therefore, the propeller rollers 61, 61*a*, 71, and 71*a* are usually pressed against the surface of the drag rollers 40 and 41 regardless of whether the rotary printing press P is operated or halted.

Therefore, the hydraulic cylinders 70, 70*a*, 80, and 80*a* remain unchanged in terms of feed and drainage conditions of pressure fluid, thereby maintaining the state in which the propeller rollers 61 and 61*a* press the superposed paper webs W against the surface of the immobilized first drag roller 40, while the propeller rollers 71 and 71*a* press the superposed paper webs W against the surface of the immobilized second drag roller 41.

Thus, the superposed paper webs W are held immobile.

The paper-web holding apparatus 1 according to the second embodiment will next be described.

As shown in FIGS. 4 and 5, the paper-web holding apparatus 1 according to the second embodiment employs the third paper presser mechanism 8, which is configured in the following manner. Two propeller rollers 81 are rotatably provided in opposition to the corresponding opposite edge portions of the paper web W wrapped around the third drag roller 42.

A bracket 86 having an appropriate shape is attached to a stay F3, which extends between the opposite frames F.

An intermediate portion of a pivotal arm 83 is pivotably attached to an end portion of the bracket 86 by means of a pivot shaft 85. The pivotal arm 83 assumes an appropriate shape such as a straight shape or a bent shape. One end portion of the pivotal arm 83 is a roller arm 83*a*, whereas the other end portion is a cylinder arm 83*b*.

A propeller roller 81 is rotatably attached to an end portion of the roller arm 83*a* by means of a pin 82.

A hydraulic cylinder 84 is pivotably connected to an appropriate intermediate portion of the bracket 86. Specifically, an end portion of a cylinder body of the hydraulic cylinder 84 is pivotably connected to the bracket 86 by means of a pin 87. An end portion 88 of a piston rod of the hydraulic cylinder 84 is pivotably connected to an end portion of the cylinder arm 83*b* of the pivotal arm 83 by means of a pin 89.

The axes of the above-mentioned pin connections of the propeller roller 81, the pivotal arm 83, and the hydraulic cylinder 84 are parallel with the axis of rotation of the drag roller 42. The cylinder body of the hydraulic cylinder 84 is connected to the unillustrated pressure fluid source and to the unillustrated drain port via a second control unit 106 as shown in FIG. 4, whereby pressure fluid having an appropriately regulated pressure can be supplied to and drained from the cylinder body.

Supply of pressure fluid having an appropriately regulated pressure to or drainage of the fluid from the hydraulic cylinder 84 causes expansion or retraction of the piston rod of the cylinder, whereby the pivotal arm 83 is pivoted about the pivot shaft 85. Specifically, the hydraulic cylinder 84 is operated in the following manner. Referring to FIG. 5, when the rotary printing press P is operated, the piston rod of the hydraulic cylinder 84 expands. Thus, the pivotal arm 83 is pivoted clockwise, whereby the propeller roller 81 retreats from the surface of the third drag roller 42. When the rotary printing press P is halted, the piston rod of the hydraulic cylinder 84 retracts. Thus, the pivotal arm 83 is pivoted counterclockwise, whereby the propeller roller 81 presses the paper web W against the surface of the third drag roller 42.

The third paper presser mechanism 8 includes a single propeller roller 81 which is provided at an appropriate position along the width direction of the traveling paper web W, or a plurality of propeller rollers 81 which are provided at appropriate intervals along the width direction.

In the illustrated example, at least two propeller rollers 81 are provided in opposition to the opposite edge portions of the paper web W.

As shown in FIGS. 4 and 5, the second rotation restraint mechanism 100 of the paper-web holding apparatus 1 according to the second embodiment includes a second brake disk 101, a second brake unit 103, and a second control unit 106. The second brake disk 101 is attached to the outer side face of the toothed pulley 45*b* of the third drag roller 42 by use of bolts. The second brake unit 103 is adapted to hydraulically restrain rotation of the second brake disk 101. The second control unit 106 controls operation of the second brake unit 103 by changing over operation modes of a solenoid valve 107 for changing flow paths of pressure fluid.

The paper-web holding apparatuses 1 according to the third and fourth embodiments will next be described.

As shown in FIG. 8, the paper-web holding apparatuses 1 according to the third and fourth embodiments include substantially the same paper presser mechanism; i.e., the third paper presser mechanism 8 (FIG. 5) of the paper-web holding apparatus 1 according to the second embodiment.

As shown in FIGS. 6 and 8, the third rotation restraint mechanism 110 of the paper-web holding apparatus 1 according to the third embodiment includes a third brake disk 111, a third brake unit 113, and a third control unit 116. The third brake disk 111 is attached to one end shaft 22 of the first guide roller 2 (FIG. 6 shows one end portion thereof). The third brake unit 113 is adapted to hydraulically restrain rotation of the third brake disk 111. The third control unit 116 controls operation of the third brake unit 113 by changing over operation modes of a solenoid valve 117 for changing flow paths of pressure fluid.

As shown in FIGS. 7 and 8, the fourth rotation restraint mechanism 120 of the paper-web holding apparatus 1 according to the fourth embodiment includes a fourth brake disk 121, a fourth brake unit 123, and a fourth control unit 126. The fourth brake disk 121 is unitarily attached to an end face of a roller body 31 of the second guide roller 3 (FIG. 7 shows one end portion thereof). The fourth brake unit 123 is adapted to hydraulically restrain rotation of the fourth brake disk 121. The fourth control unit 126 controls operation of the fourth brake unit 123 by changing over operation modes of a solenoid valve 127 for changing flow paths of pressure fluid.

The above-described second brake unit 103, third brake unit 113, and fourth brake unit 123 (see FIGS. 4, 6, and 7) are substantially identical with the first brake unit 93 (see FIG. 1) of the first rotation restraint mechanism 9 of the first drag roller apparatus 4.

The second brake unit 103 (the third brake unit 113 or the fourth brake unit 123) includes two cylinder members 103*a* (113*a* or 123*a*) and two brake members 105 (115 or 125). The cylinder members 103*a* (113*a* or 123*a*) are mounted on a bracket 104 (114 or 124), which is attached to the frame F, in such a manner as to face each other with the second brake disk 101 (the third brake disk 111 or the fourth brake disk 121) located therebetween and such that open ends thereof are located in the vicinity of corresponding braking faces of the second brake disk 101 (the third brake disk 111 or the fourth brake disk 121). The brake members 105 (115 or 125) are slidably received within the corresponding cylinder members 103*a* (113*a* or 123*a*) in such a manner as to be able to grip the second brake disk 101 (the third brake disk ill or the fourth brake disk 121) through contact, from opposite sides, with the braking faces of the brake disk and to retreat from the braking faces.

The second control unit 106, the third control unit 116, and the fourth control unit 126 are substantially identical with one another (see FIGS. 4, 6, and 7).

The second control unit 106 (the third control unit 116 or the fourth control unit 126) includes a pipe line 108 (118 or 128) and the solenoid valve 107 (117 or 127). The pipe line 108 (118 or 128) connects the unillustrated pressure fluid source and the unillustrated drain port to the cylinder body of the hydraulic cylinder 84 of the third paper presser mechanism 8, as well as to the cylinder members 103*a* (113*a* or 123*a*) of the second brake unit 103 (the third brake unit 113 or the fourth brake unit 123). The solenoid valve 107 (117 or 127) is operated by means of an operation signal 106*a* (116*a* or 126*a*) and a stop signal 106b (116*b* or 126*b*) to be input from the unillustrated control unit of the rotary printing press P. The solenoid valve 107 (117 or 127) changes over flow paths of pressure fluid according to the operation signal or the stop signal in the following manner.

Upon input of the operation signal 106*a* (116*a* or 126*a*) to one solenoid 107*a* (117*a* or 127*a*), the solenoid valve 107 (117 or 127) establishes communication between the drain port and the cylinder members 103*a* (113*a* or 123*a*), communication between the pressure fluid source and the side of the cylinder body of the hydraulic cylinder 84 opposite the piston rod, and communication between the drain port and the side of the cylinder body toward the piston rod.

Upon input of the stop signal 106*b* (116*b* or 126*b*) to the other solenoid 107*b* (117*b* or 127*b*), the solenoid valve 107 (117 or 127) establishes communication between the pressure fluid source and the cylinder members 103*a* (113*a* or 123*a*), communication between the pressure fluid source and the side of the cylinder body of the hydraulic cylinder 84 toward the piston rod, and communication between the drain port and the side of the cylinder body opposite the piston rod (see FIGS. 4, 6, and 7).

Specific operations are described below.

When the cylinder members 103*a* (113*a* or 123*a*) communicate with the pressure fluid source, pressure fluid fed to the cylinder members causes the brake members 105 (115 or 125) to be pressed against the corresponding braking faces of the second brake disk 101 (the third brake disk 111 or the fourth brake disk 121), thereby braking the brake disk.

When the cylinder members 103*a* (113*a* or 123*a*) communicate with the drain port, an unillustrated compression spring causes the brake members 105 (115 or 125) to retreat from the braking faces of the second brake disk 101 (the third brake disk 111 or the fourth brake disk 121), and the pressure fluid is drained from the cylinder members to the drain port. Thus, the second brake disk 101 (the third brake disk 111 or the fourth brake disk 121) is released from grip by the brake members 105 (115 or 125); i.e., the brake disk is released from restraint.

In the case where the pressure fluid source communicates with the side of the cylinder body of the hydraulic cylinder 84 toward the piston rod, while the drain port communicates with the side of the cylinder body opposite the piston rod, the propeller roller 81 presses the paper web W against the surface of the third drag roller 42 (the first guide roller 2 or the second guide roller 3). In the case where the pressure fluid source communicates with the side of the cylinder body of the hydraulic cylinder 84 opposite the piston rod, while the drain port communicates with the side of the cylinder body toward the piston rod, the propeller roller 81 retreats from the third drag roller 42 (the first guide roller 2 or the second guide roller 3), thereby releasing the paper web W.

Next will be described operation of the paper-web holding apparatus 1 according to the second embodiment.

When the rotary printing press P, which has been halted, enters an operation status, the paper-web holding apparatus 1 operates in the following manner. The operation signal 106*a* is input to the second control unit 106 of the second rotation restraint mechanism 100 shown in FIG. 4 from the unillustrated control unit of the rotary printing press P, to thereby activate the solenoid 107*a*. The solenoid valve 107 immediately changes over flow paths of pressure fluid in relation to the pipe line 108, which is connected to the cylinder members 103*a* of the second brake unit 103 of the second rotation restraint mechanism 100 and to the hydraulic cylinder 84 of the third paper presser mechanism 8.

Specifically, the flow paths of pressure fluid are changed over such that the cylinder members 103*a* of the second brake unit 103 communicate with the unillustrated drain port and such that, in the hydraulic cylinder 84 of the third paper presser mechanism 8, one side of the cylinder body thereof communicates with the unillustrated pressure fluid source, while the other side of the cylinder body communicates with the drain port.

Hereupon, imposition of fluid pressure on the brake members 105 is canceled. As a result, an unillustrated compression spring causes the brake members 105, which have been gripping the second brake disk 101, to retreat from the braking faces of the second brake disk 101, and the pressure fluid is drained from the cylinder members 103*a* to the drain port. Thus, the second brake disk 101 is released from restraint, whereby the third drag roller 42 becomes rotatable.

Further, the pressure fluid is fed, via the pipe line 108, into the cylinder body of the hydraulic cylinder 84 of the third paper presser mechanism 8 from one side of the cylinder body, while the pressure fluid is drained from the other side of the cylinder body. Thus, the piston rod of the hydraulic cylinder 84 expands, thereby causing the pivotal arm 83 to pivot clockwise about the pivot shaft 85. As a result, the propeller roller 81 releases the paper web W wrapped around the third drag roller 42.

As the rotary printing press P is operated, unillustrated motors for rotating the third drag rollers 42 rotate synchronously with rotation of the printing cylinders T (see FIG. 9). As in the case of the first embodiment, rotation of each of the unillustrated motors is transmitted via the toothed belt 47*a* to the toothed pulley 45*b* attached to the shaft end portion 42*b* of the third drag roller 42, thereby rotating each of the third drag rollers 42. The rotating third drag rollers 42 feed the corresponding printed paper webs W toward the folding unit R.

When the rotary printing press P is normally halted after completion of regular operation, an unillustrated motor stops. When paper breaks during the course of printing, the motor starts decelerating to make an emergency stop. When the motor stops normally or makes an emergency stop, the stop signal 106*b* is input to the second control unit 106 from the control unit of the rotary printing press P to thereby activate the solenoid 107*b*. The solenoid valve 107 immediately changes over flow paths of pressure fluid in relation to the pipe line 108 connected to the cylinder members 103*a* of the second brake unit 103 and to the hydraulic cylinder 84 of the third paper presser mechanism 8.

Specifically, the flow paths of pressure fluid are changed over such that the cylinder members 103*a* of the second brake unit 103 communicate with the unillustrated pressure fluid source and such that, in the hydraulic cylinder 84 of the third paper presser mechanism 8, communication of the cylinder body thereof with the unillustrated pressure fluid source and with the unillustrated drain port is reversed.

Then, the pressure fluid is fed into the cylinder members 103*a* to thereby impose a hydraulic pressure on the two brake members 105. The brake members 105, which have been retreated from the corresponding braking faces of the second brake disk 101, are pressed against the braking faces against a force of an unillustrated compression spring, thereby braking the second brake disk 101 to thereby restrain rotation of the second brake disk 101. As a result, the third drag roller 42 completely stops and becomes immobile.

Further, the pressure fluid is fed into the cylinder body of the hydraulic cylinder 84 of the third paper presser mechanism 8 from one side of the cylinder body, while the pressure fluid is drained from the other side of the cylinder body. Thus, the piston rod of the hydraulic cylinder 84 retract, thereby causing the pivotal arm 83 to pivot counterclockwise about the pivot shaft 85. As a result, the propeller roller 81 presses the paper web W against the surface of the third drag roller 42.

Thus, movement of the paper web W is restrained, and thus the paper web W is held immobile.

Notably, in the second embodiment, the third paper presser mechanism 8 may not be operated in an interlocking relation to the second brake unit 103, but may be operated in the following manner. The pipe line 108 extending to the hydraulic cylinder 84 is connected to an unillustrated selector valve for pressure fluid. As in the case of the first embodiment, the propeller roller 81 is, at all times, in contact with the surface of the third drag roller 42 regardless of whether the rotary printing press P is operated or halted.

Next will be described operation of the paper-web holding apparatus 1 according to the third embodiment (the fourth embodiment).

When the rotary printing press P, which has been halted, enters an operation status, the paper-web holding apparatus 1 operates in the following manner. The operation signal 116*a* (126*a*) is input to the third control unit 116 shown in FIG. 6 (the fourth control unit 126 shown in FIG. 7) from the unillustrated control unit of the rotary printing press P, to thereby activate the solenoid 117*a* (127*a*). The solenoid valve 117 (127) immediately changes over flow paths of pressure fluid in relation to the pipe line 118 (128), which is connected to the third brake unit 113 (the fourth brake unit 123) of the third rotation restraint mechanism 110 (the fourth rotation restraint mechanism 120) and to the hydraulic cylinder 84 of the third paper presser mechanism 8.

Specifically, the flow paths of pressure fluid are changed over such that the cylinder members 113*a* (123*a*) of the third brake unit 113 (the fourth brake unit 123) communicate with the unillustrated drain port and such that, in the hydraulic cylinder 84 of the third paper presser mechanism 8, one side of the cylinder body thereof communicates with the unillustrated pressure fluid source, while the other side of the cylinder body communicates with the drain port.

Hereupon, imposition of fluid pressure on the brake members 115 (125) is canceled. As a result, an unillustrated compression spring causes the brake members 115 (125), which have been gripping the third brake disk 111 (the fourth brake disk 121), to retreat from the braking faces of the third brake disk 111 (the fourth brake disk 121), and the pressure fluid is drained from the cylinder members 113*a* (123*a*) to the drain port. Thus, the third brake disk 111 (the fourth brake disk 121) is released from restraint, whereby the first guide roller 2 (the second guide roller 3) becomes rotatable.

Further, as in the case of the second embodiment, the propeller roller 81 of the third paper presser mechanism 8 releases the paper web W wrapped around the first guide roller 2 (the second guide roller 3), whereby the paper web W is allowed to travel.

As the rotary printing press P is operated, the drag roller apparatuses rotate synchronously with rotation of the printing cylinders T (see FIG. 9), thereby causing the printed paper webs W to travel. The printed paper webs W travel toward the folding unit R along predetermined paths which are partially defined by the first and second guide rollers 2 and 3.

When the rotary printing press P is normally halted after completion of regular operation or when paper breaks during the course of printing, the stop signal 116*b* (126*b*) is input to the third control unit 116 (the fourth control unit 126) from the control unit of the rotary printing press P to thereby activate the solenoid 117*b* (127*b*). The solenoid valve 117 (127) immediately changes over flow paths of pressure fluid in relation to the pipe line 118 (128) connected to the cylinder members 113*a* (123*a*) of the third brake unit 113 (the fourth brake unit 123) and to the hydraulic cylinder 84 of the third paper presser mechanism 8.

Specifically, the flow paths of pressure fluid are changed over such that the cylinder members 113*a* (123*a*) of the third brake unit 113 (the fourth brake unit 123) communicate with the unillustrated pressure fluid source and such that, in the hydraulic cylinder 84 of the third paper presser mechanism 8, communication of the cylinder body thereof with the unillustrated pressure fluid source and with the unillustrated drain port is reversed.

Then, the pressure fluid is fed into the cylinder members 113*a* (123*a*) of the third brake unit 113 (the fourth brake unit 123) to thereby impose a hydraulic pressure on the two brake members 115 (125). The brake members 115 (125), which have been retreated from the third brake disk 111 (the fourth brake disk 121), are pressed against the braking faces of the third brake disk 111 (the fourth brake disk 121) against a force of an unillustrated compression spring, thereby braking the third brake disk 111 (the fourth brake disk 121) to thereby restrain rotation of the brake disk. As a result, the first guide roller 2 (the second guide roller 3) completely stops and becomes immobile.

Further, as in the case of the second embodiment, the propeller roller 81 of the third paper presser mechanism 8 presses the paper web W against the surface of the immobile first guide roller 2 (the immobile second guide roller 3).

Thus, movement of the paper web W is restrained, and thus the paper web is held immobile.

The above embodiments are described while mentioning a hydraulically operated brake unit. However, the present invention is not limited thereto. For example, a magnetoelectric mechanism may be employed and controlled such that brake members are magnetoelectrically caused to be pressed against or to retreat from a brake disk.

The paper-web holding apparatus for a rotary printing press according to the present invention provides the following advantageous effects.

When the rotary printing press is halted after normal completion of operation, the weight of a paper web, a return movement of the corresponding floating roller, or a like factor may exert a pullback force on the paper web. However, since rotation of the drag roller located upstream of the folding cylinder can be restrained, the paper web which has reached the folding cylinder does not slip on the folding cylinder.

Therefore, when operation is resumed, no paper jam occurs in the periphery of the folding cylinder, thereby obviating manual work in startup of the rotary printing press and facilitating the startup.

Similarly, in the event of breakage of a paper web during the course of printing for reasons of an unexpected trouble in the rotary printing press, the weight of the paper web, a return movement of the corresponding floating roller, or a like factor may exert a pullback force on the paper web. However, since a propeller roller presses the paper web in contact with a selected guide roller against the surface of the guide roller, and rotation of the guide roller can be restrained, the paper web can be restrained on the surface of the guide roller without slippage off the roller. Therefore, when the rotary printing press is to be started up, web threading can be resumed immediately, thereby minimizing loss in printing throughput.

In the field of newspaper printing, where start and stop of the rotary printing press are carried out more frequently than in the ordinary field of printing, elimination of pullback of a paper web eliminates the possibility of a paper jam in the periphery of a folding cylinder, thereby reducing waste of paper and thus contributing to conservation of resources and enhanced productivity.

Additionally, elimination of the possibility of a paper jam in the periphery of a folding cylinder eliminates the possibility of breakage of mechanical components in the periphery of the folding cylinder, which breakage would otherwise result from the paper jam, thereby reducing a maintenance work-load of the rotary printing press.

Obviously, numerous modifications and variations of the present invention are possible in light of the above teachings. It is therefore to be understood that within the scope of the appended claims, the present invention may be practiced otherwise than as specifically described herein.

What is claimed is:

1. A paper-web holding apparatus for a rotary printing press having rollers which form a path for a paper web fed from a paper web feeding unit to travel along to a folding unit via a press unit and around which the paper web is wrapped, comprising:

a rotation restraint mechanism provided for at least one selected roller and adapted to restrain rotation of said roller when the rotary printing press is halted, and to allow rotation of said roller when the rotary printing press is operated; and a paper presser mechanism provided for said selected roller and having a pressing member which is retreatably advanced toward said roller in order to apply pressing force to said roller at least when the rotary printing press is in halt.

2. A paper-web holding apparatus in a rotary printing press according to claim 1, wherein said rotation restraint mechanism comprises a brake unit provided in the vicinity of an end portion of said selected roller, and a control unit for controlling operation of said brake unit.

3. A paper-web holding apparatus in a rotary printing press according to claim 2, wherein said brake unit is hydraulically operable.

4. A paper-web holding apparatus in a rotary printing press according to claim 2, wherein said brake unit is magnetoelectrically operable.

5. A paper-web holding apparatus in a rotary printing press according to claim 1, wherein said selected roller is a drag roller.

6. A paper-web holding apparatus in a rotary printing press according to claim 1, wherein said selected roller is a guide roller.

7. A paper-web holding apparatus in a rotary printing press according to claim 1, wherein a guide roller and a drag roller are selected as said selected roller.

8. A paper-web holding apparatus in a rotary printing press according to claim 5 or 7, wherein said drag roller is a drag roller located above and upstream of a former for feeding paper web to the folding unit.

9. A paper-web holding apparatus in a rotary printing press according to claim 5 or 7, wherein a plurality of drag rollers, including a drag roller located above and upstream of a former for feeding paper web to the folding unit, are selected as said selected roller.

* * * * *